United States Patent [19]

Miyamoto

[11] 4,010,702

[45] Mar. 8, 1977

[54] AUTOMATIC THREADING DEVICE FOR SEWING MACHINES

[76] Inventor: Toshio Miyamoto, 17-27, 2-chome Himezato, Nishiyodogawa, Osaka, Japan

[22] Filed: Sept. 3, 1975

[21] Appl. No.: 610,058

[30] Foreign Application Priority Data

| | | |
|---|---|---|
| Oct. 8, 1974 | Japan | 49-116654 |
| Feb. 6, 1975 | Japan | 50-17055 |
| Sept. 3, 1974 | Japan | 49-102192 |
| Sept. 3, 1974 | Japan | 49-102193 |

[52] U.S. Cl. ..... 112/225; 112/242; 112/254

[51] Int. Cl.² ..... D05B 87/02

[58] Field of Search ..... 112/225, 224, 79 R, 112/79 A, 218 R; 223/99

[56] References Cited

UNITED STATES PATENTS

| | | | |
|---|---|---|---|
| 2,866,424 | 12/1958 | Masland | 112/79 A |
| 3,364,889 | 1/1968 | Weimer | 112/218 R |
| 3,502,045 | 3/1970 | Hanyu | 112/225 |
| 3,508,690 | 4/1970 | Pozzolo | 112/225 X |
| 3,540,392 | 11/1970 | Kaplan | 112/225 |

*Primary Examiner*—H. Hampton Hunter
*Attorney, Agent, or Firm*—George B. Oujevolk

[57] ABSTRACT

An automatic threading device for sewing machines is disclosed which can thread the needle thereon automatically. It carries with a stream of air the thread from a thread feeder through the thread take-up at standstill, guides it to the front of the needle hole, and passes it through the needle by means of a threading tool.

5 Claims, 13 Drawing Figures

AUTOMATIC THREADING DEVICE FOR SEWING MACHINES

The present invention relates to an automatic threading device for sewing machines which guides a thread to the front of the needle hole by a stream of air and passes it through the needle by means of a threading tool.

Conventionally, threading has been done by hand upon thread breakage on a sewing machine of this kind.

It is an object of the present invention to provide a threading device for sewing machines which can thread the thread take-up and the needle automatically, rapidly and securely.

It is another object of the present invention to provide a threading device which permits automatic threading for sewing machines of a very simple mechanism using a stream of air for the threading through the thread take-up and for the guiding of the thread to the needle hole.

It is a further object of the present invention to provide a threading device of the aforesaid type on which the thread is released from a thread guide pipe upon completion of threading to allow it to be fed more smoothly during sewing.

Other features and advantages of the present invention will become apparent from the following description with reference to the accompanying drawings, in which.

Figure 1:
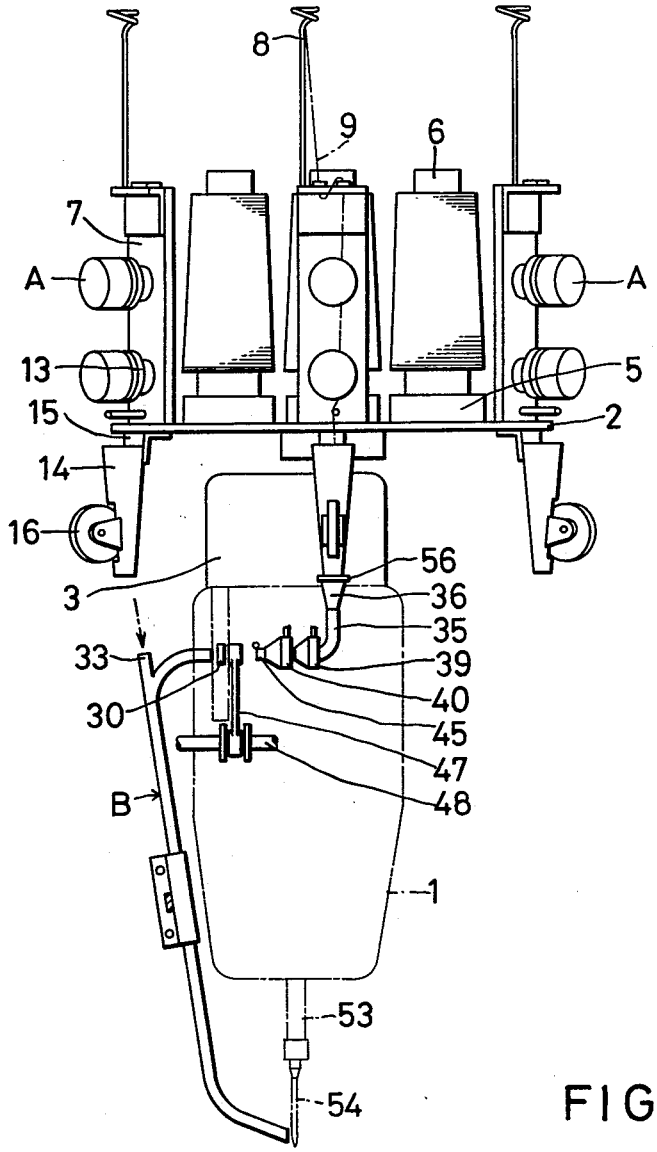
FIG. 1 is a front view of a first embodiment of the present invention.

In the first embodiment shown in FIGS. 1 to 5, the thread from a thread feeder on the sewing machine is sucked into a thread suction pipe by a stream of air. Leaving the suction pipe, the thread is passed through the hole in the thread take-up and then led into a thread guide pipe through which it is driven by air to the outlet at its bottom. The thread is caught by a threading tool at the outlet and passed through the needle on the sewing machine. After threading, the thread guide pipe is split into two to release the thread.

Referring to FIGS. 1 to 5, the numeral 1 designates the arm of a sewing machine. A rotary table 2 is mounted on the arm 1 to be turned intermittently by means of driving means 3 through a shaft 4. The rotary table 2 has a plurality of bobbin holders 5 arranged thereon circumferentially at a regular angular distance. A bobbin 6 is mounted on each bobbin holder 5. At outside of each bobbin holder 5 is secured a frame 7 to the outer periphery of the rotary table 2.

At top of each frame 7 is provided a thread guide 8 through which the thread 9 from the bobbin 6 is led to a thread tension regulator A provided at outside of the frame 7. This regulator A is an ordinary thread tension regulator for sewing machines which has two spring-loaded tension discs 10 for giving tension to the thread passed therebetween. By turning a dial 11, the bias of the spring can be adjusted. When pressed, a pin 12 projecting from the rear of the regulator A relaxes the spring for the tension discs, thus removing tension to the thread. A roller 13 below each regulator A is a mere grooved guide roller, though it is shown to be of a similar shape.

Just under each guide roller 13 is secured a tapered guide tube 14 to the rotary table 2 through a bracket 15, said guide tube being open at both ends and being of a smaller diameter at its lower end. A rubber feed roller 16 is rotatably pivoted to the outside of the guide tube 14 so as for a portion thereof to project thereinto through a vertical slit formed therein.

The numeral 19 designates driving means to which is connected a pivotable lever 17 actuated by an electromagnet, for example, and carrying a driving roller 18 at its tip. The driving roller 18 is driven in the direction of arrow through belt or gear from a motor in the driving means 19. When the lever 17 is in its lower position, the driving roller 18 projects into the guide tube 14 through another vertical slit formed therein to cooperate with the feed roller 16 to feed down the thread 9 held therebetween.

Figure 5:
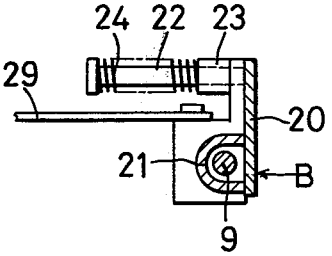
FIG. 5 is an enlarged cross-sectional view of the thread guide pipe thereof.
Figure 4:
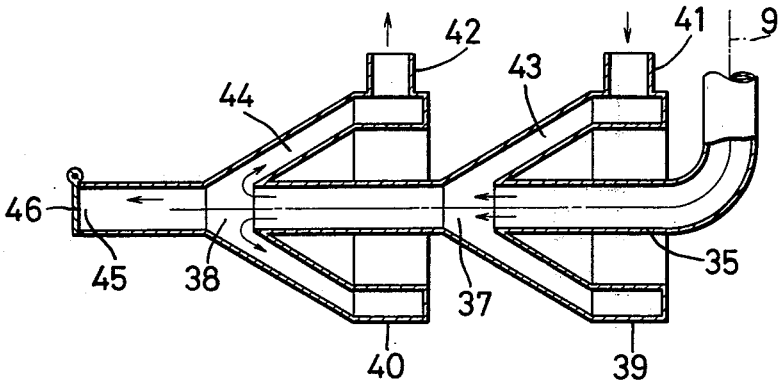
FIG. 4 is an enlarged vertical cross-sectional view of the thread suction pipe thereof.

The letter B designates a thread guide pipe which leads the thread to directly before the hole in the needle 54. It consists of an elongated base plate 20 and a removable cover member 21 of U-shape section mounted thereon to form a pipe. (FIGS. 3 and 5) The base plate 20 is fixed to the end of the arm 1. As shown in FIG. 5, two guide shafts 22 on the base plate 20 are adapted to slidably fit into two guide tubes 23 on the cover member 21 with a spring 24 placed between each guide shaft 22 and the corresponding guide tube 23 to urge the cover member 21 against the base plate 20.

Driving means 25 such as an electromagnet or an air cylinder is secured at a suitable position on the arm 1, said driving means having a rod 26 coupled to a lever 27 at its top end. The lever 27 is pivoted to the arm 1 through an axis 28 intermediately of its length. The lower end of the lever 27 is coupled to the cover member 21 through a coupling rod 29.

The thread guide pipe B is curved adjacent to its top end toward the thread take-up 30 of the sewing machine so that its inlet 32 is opposed to the thread hole 31 therein. At the curve of the guide pipe B is provided a blast port 33 to suck the thread 9 thereinto and feed it to the outlet 34 at the bottom by a stream of air.

A suction pipe 35 curved into L shape is secured to the end of the arm 1 at such a position that a tapered portion 36 at its top is directly under the guide tube 14 in its thread-feeding position. Intermediately of the suction pipe 35 are formed two spaces 37 and 38 at the outer periphery of which are provided a blast box 39 and a suction box 40 connected to a vacuum pump (not shown), respectively, to which are connected a blast line 41 and a suction line 42 connected to an air pump (not shown), respectively. The blast box 39 communicates with the space 37 through an annular tapered passage 43, and the suction box 40 similarly does with the space 38 through another annular tapered passage 44. A check valve 46 is provided at the outlet 45 of the suction pipe 35 to prevent air stream from flowing back into the pipe 35.

A lever 47 is pivoted to the arm 1 through an axis 48. When it is pivoted up, a thread hole 49 in its tip comes between the outlet 45 of the suction pipe 35 and the hole 31 in the thread take-up 30 in alignment therewith.

A rod 50 is slidable along a guide suitably provided on the arm 1 and has a hard wire 51 fixed at its tip and formed with a hook 52 turned upward to catch the thread.

A needle 54 having a hole 55 formed therein is attached to the lower end of a needle holder 53. The arm 1 is also provided with an automatic thread cutter 56 of a scissors type, for example, for cutting the thread directly over the tapered portion 36 when actuated by an electromagnet.

The operation of the first embodiment will now be described. With the hole 31 in the thread take-up 30, the hole 49 in the lever 47, the outlet 45 of the suction pipe 35 and the inlet 32 of the thread guide pipe B in alignment with one another, the driving means 19 operates to pivot down the lever 17 to put the driving roller 18 into its operative position. The thread 9 pending from the guide roller 13 is caught between the rollers 16 and 18 and is fed down as the roller 18 is being rotated in the direction of arrow.

When the thread 9 reaches the tapered portion 36, a solenoid valve in the suction line 42 has already opened so that it is sucked into the suction pipe 35. The thread 9 moves through the suction pipe 35 toward its outlet 45 by the feeding action of the rollers 16 and 18 and suction by the suction pipe 35. When it arrives at the space 38, a solenoid valve in the blast line 41 opens to allow compressed air to blow through the passage 43 and the space 37 toward the outlet 45. Then the solenoid valve in the suction line 42 closes. Thus the thread 9 finds its way toward the outlet 45 with the stream of air. Forced open by air stream, the check valve 46 allows the thread 9 to pass through the outlet 45. It then passes through the holes in the lever 47 and in the thread take-up 30 toward the inlet 32 of the thread guide pipe B, which is now closed with the cover member 21 closely mounted on the base plate 20 with both ends left open.

Because compressed air blown into the pipe B from the blast port 33 sets its inlet 32 under negative pressure, the thread 9 is sucked thereinto, making its way downward therethrough toward the outlet 34.

While air stream carries the thread 9, the rollers 16 and 18 keep rotating to feed it down. The feeding speed is preferably adjusted to be slightly lower than the speed at which it is carried by air, to prevent it from loosening.

On the sewing machine embodying the present invention, if it automatically stops upon thread breakage, for example, the needle 54 comes up through the cloth into position and the thread take-up 30 comes to position for threading.

Upon automatic stop of the machine, the driving means for the rod 50 also operates to advance it until the hook 52 passes through the needle hole 55 and stops slightly beyond the thread outlet 34. After the tip of the thread 9 from the outlet 34 has gotten on the hard wire 51, the rod 50 retracts, thereby catching the thread by the hook 52 and passing it through the needle hole 55.

Figure 2:
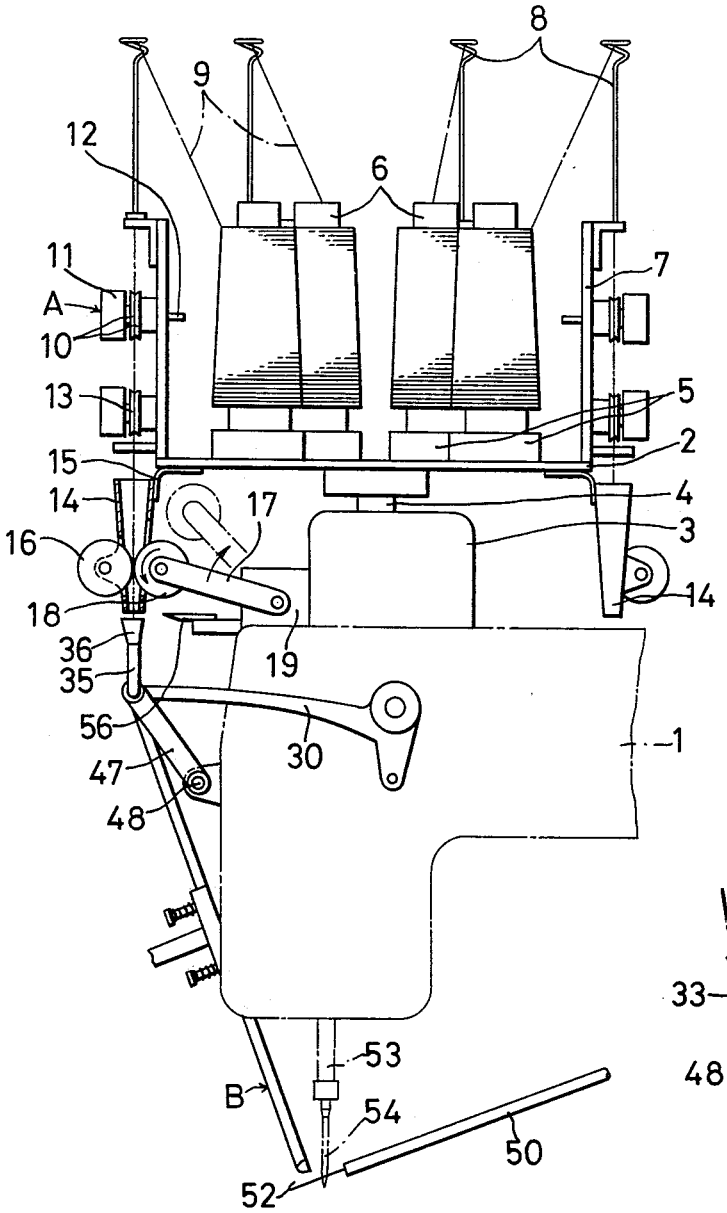
FIG. 2 is a side view thereof.

The driving means 19 then operates to pivot up the lever 17 (as shown in FIG. 2 by an alternate long and short dash line) to get the roller 18 off the roller 16. Simultaneously, the driving means 25 also operates to retract the rod 26 to pull the cover member 21 off the base plate 20 through the lever 27 and the coupling rod 29 against the bias of the spring 24. This produces a gap between the base plate 20 and the cover member 21 over a substantially whole length thereof.

When in this condition the lever 47 pivots down and the sewing machine starts, the thread 9 comes out of the thread guide pipe B. Thereafter the rod 26 advances to allow the cover member 21 to get back into close contact with the base plate 20 by action of the spring 24 to close the thread guide pipe B.

During the feeding of thread by the rollers 16 and 18, the pin 12 for the tension discs 10 may be pressed by a lever actuated by an electromagnet to remove tension to the thread to facilitate the feeding-out of the thread.

Also, on such a sewing machine having a rotary table 2 as illustrated, the machine may be so designed that after stoppage of the machine by a signal from a suitable control system and cutting of the thread by the automatic thread cutter 56, the rotary table 2 is turned to put a desired bobbin 6 in a feeding station. By repeating this to use a plurality of threads of different color in a predetermined order, any desired pattern can be produced.

The hook extending through the needle hole securely engages the end of the thread which has been brought through the guide pipe by air stream to directly in front of the needle hole, on thread breakage or on a thread change command. This assures secure threading through the needle.

Particularly in the aforementioned first embodiment, upon completion of threading, the thread guide pipe B is split open over its whole length to set free the thread to avoid passage of the thread therethrough during sewing, thereby ensuring smooth feeding of the thread.

Figure 6:
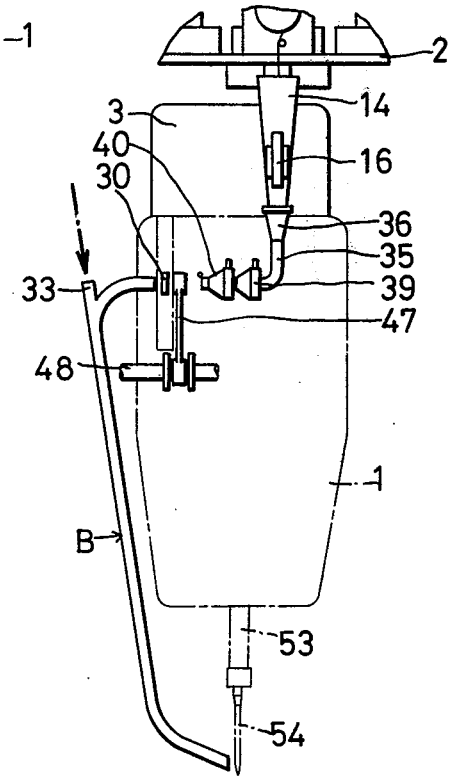
FIG. 6 is a front view of a second embodiment of the present invention.
Figure 3:
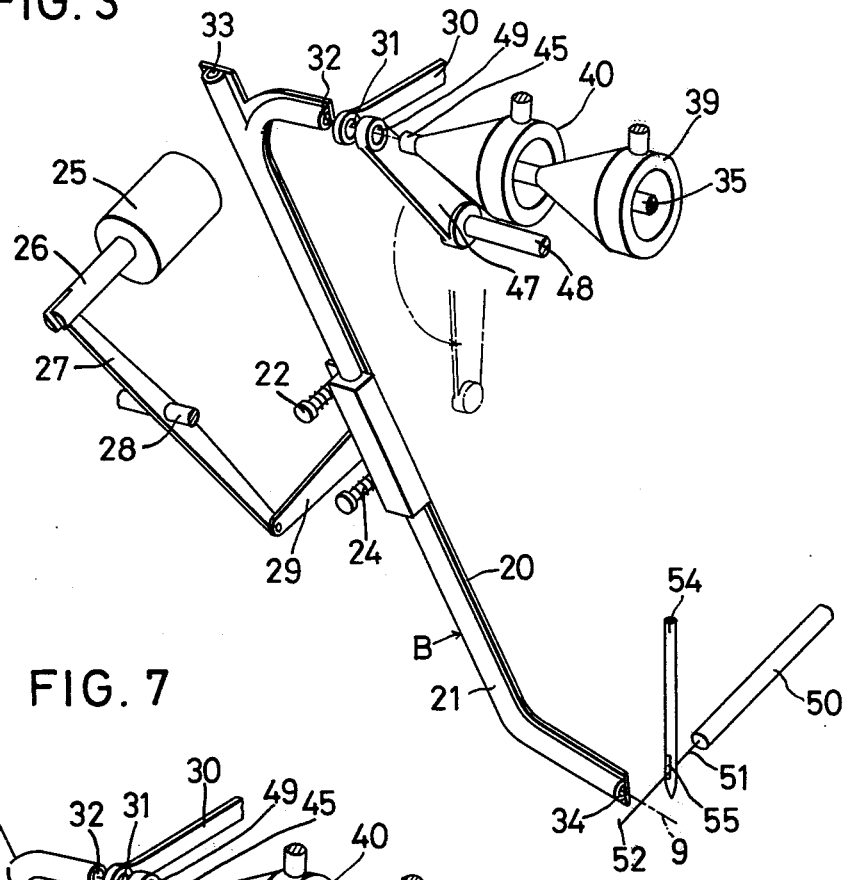
FIG. 3 is a perspective view of a portion of the device shown in FIG. 1.
Figure 7:
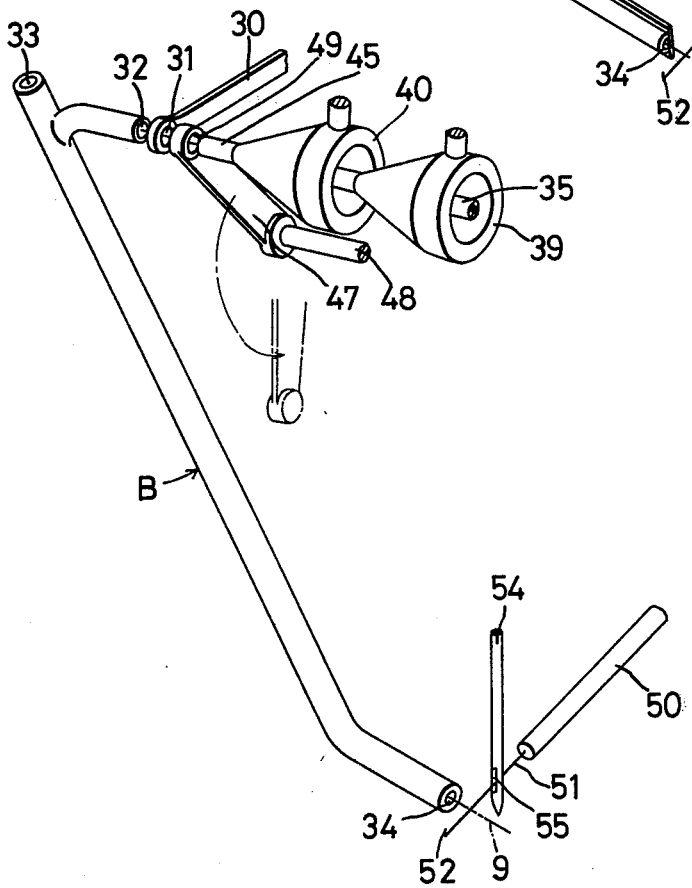
FIG. 7 is a perspective view of a portion of the device shown in FIG. 6, similar to FIG. 3.

Another or second embodiment of the present invention shown in FIGS. 6 and 7 will now be described. In the subsequent embodiments, the same parts are given the same reference numbers but with explanation omitted.

In the second embodiment, the thread guide pipe B is constituted by an unsplittable pipe which is of a suitable inside diameter. The rest is the same as the guide pipe in the first embodiment.

Thus, the thread 9 still runs through the guide pipe B even after threading and start of operation of the sewing machine. The use of an unsplittable pipe for the guide pipe B makes unnecessary the driving means and mechanism for splitting the guide pipe B, thus simplifying the construction of the device considerably.

Figure 9:
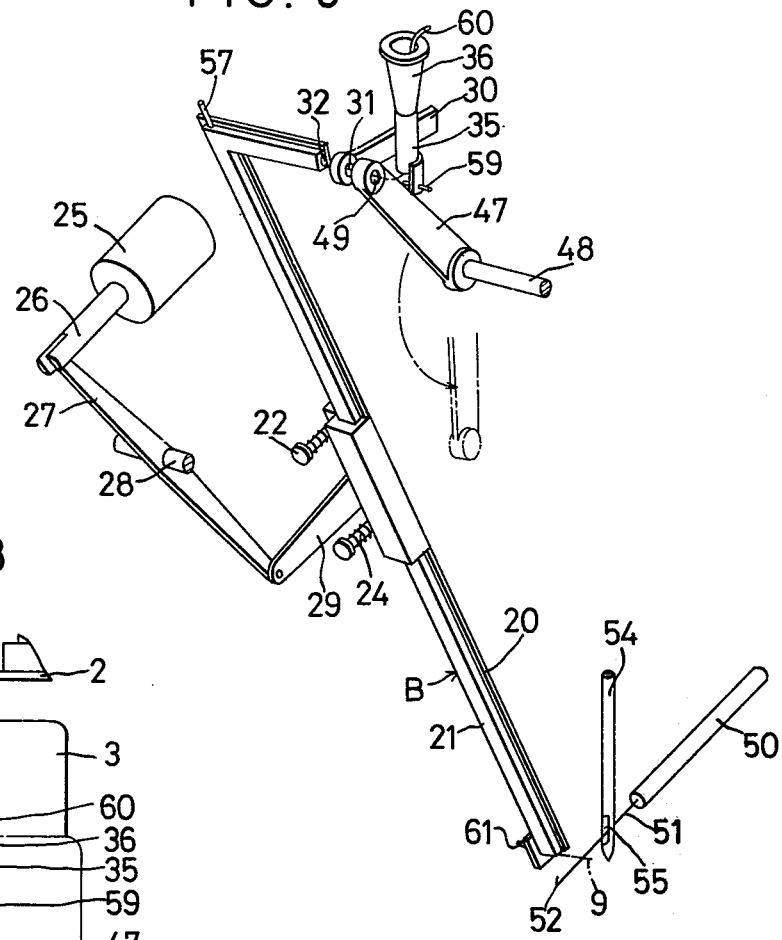
FIG. 9 is a perspective view of a portion of the device shown in FIG. 8, similar to FIG. 3.
Figure 8:
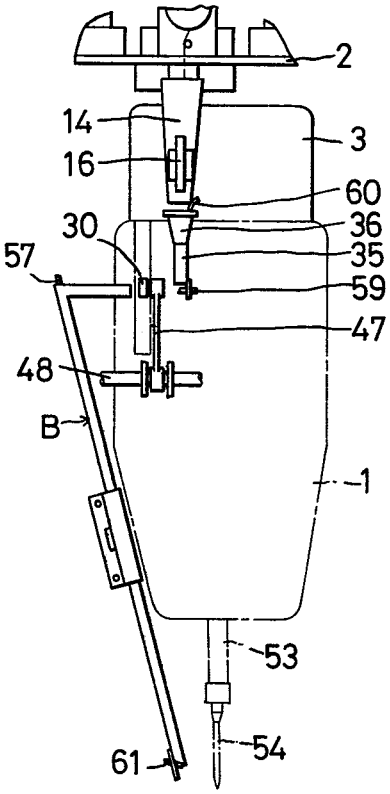
FIG. 8 is a front view of a third embodiment of the present invention.
Figure 10:
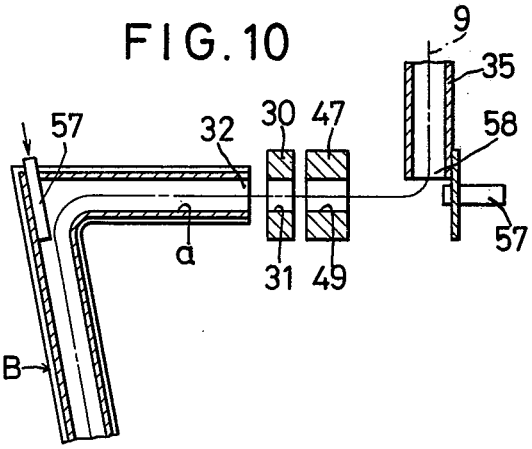
FIG. 10 is an enlarged vertical cross-sectional view of a portion thereof.

Next, a third embodiment (shown in FIGS. 8 to 10) will be described in which a blast pipe of a small diameter is provided each at the inlet and outlet of the thread suction pipe 35 and at the curve and outlet of the thread guide pipe B to ensure smoother and securer guiding of the thread.

The thread suction pipe 35 has a tapered portion 36 disposed directly under the lower opening of the guide tube 14 and an outlet 58 disposed adjacent to, and just above, the hole 31 in the thread take-up 30. A small blast pipe 60 is inserted into the tapered portion 36 to blow in compressed air to drift the thread 9 downward. This pipe 60 is offset in the portion 36 to be out of the way of the thread. To a bracket secured to the lower end of the suction pipe 35 is also attached another small blast pipe 59 for blowing the thread 9 toward the hole 31. bracket secured to the lower end of the suction pipe 35 is also attached another small blast pipe 59 for blowing the thread 9 toward the hole 31.

At the curve of the thread guide pipe B is provided a small blast pipe 57 to drive the thread 9 by air stream toward the outlet 34. It also is offset to the inner wall to be out of the way and has its lower end open below the lower wall *a* of the branch portion of the guide pipe B to prevent air blast from going into the branch portion.

Another small blast pipe 61 is attached to the lower end of the guide pipe B through a mounting bracket to blow the thread from the outlet 34 toward the needle hole 55.

In operation of the third embodiment, when the thread fed by the rollers 16 and 18 arrives at the tapered portion 36, it is sucked thereinto by action of air under pressure jet from the blast pipe 60. As soon as it comes out of the suction pipe 35, the thread 9 is blown away by air blast from the blast pipe 59 to pass through the holes 49 and 31 toward the inlet 32 of the thread guide pipe B.

Because there has already been a downward air blast from the blast pipe 57, the thread is sucked into the inlet 32 and led downward through the pipe B. By adjusting the amount of air sucked from the inlet 32 to be approximately equal to, or slightly larger than the amount of air injected from the blast pipe 59, smooth sucking-in of the thread into the inlet 32 is ensured without any disturbance of air stream adjacent to the inlet 32.

When the thread comes out of the outlet 34 of the guide pipe B, it is swept by the air stream from the blast pipe 61 to the front of the needle hole 55 for threading by the hook 52.

Figure 11:
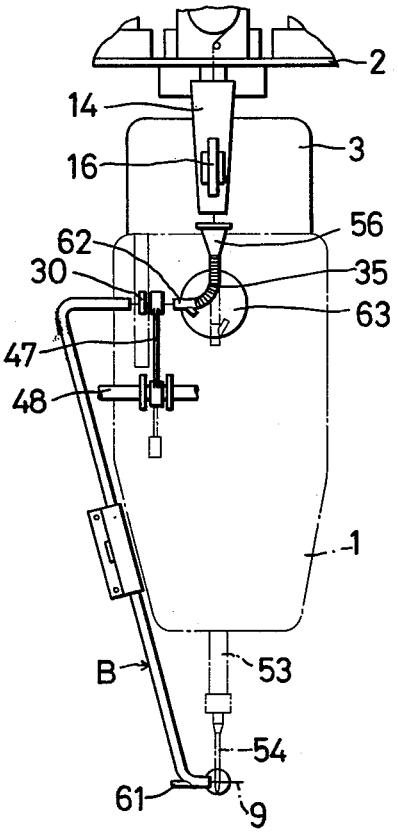
FIG. 11 is a front view of a fourth embodiment of the present invention.

A fourth embodiment of the present invention (shown in FIGS. 11 to 13) will now be described in which the suction pipe and the hook or threading tool are different from those in the foregoing embodiments.

The thread guide pipe B is curved at its lower end toward the needle 54 so as for its outlet 34 to be opposed to the needle hole 55. At the lower curve of the guide pipe B is provided a small blast pipe 61 to blow in compressed air toward the outlet 34.

To the tapered portion 36 vertically fixed to the end of the arm 1 is coupled a suction pipe 35 of a flexible material, to the other end of which is attached on outlet pipe 62 which is secured to the outer periphery of a turnable member 63. The turnable member 63 turns about its horizontal axis for approximately 90° by means of a rotary solenoid mounted to the arm 1 to selectively put the outlet pipe 62 in a position to align it with the hole 31 in the thread take-up 30 (as in FIG. 11) or in a turned-down position as shown with an imaginary line in the same figure. A small blast pipe 64 is inserted into the outlet pipe 62 from its side to direct an air stream toward its outlet.

An air cylinder 65 is mounted to the arm 1 through a mounting frame 66 (FIG. 12) and has a rod 67 slidably fitted in a tube 68 fixed to the mounting frame 66. To the tip of the rod 67 is attached a threading tool 69 which is constituted by steel wire bent into a lozenge shape. The outer wall of the tube 68 is formed with an opening 70 through which the threading tool 69 is forced in and out. The opening 70 is disposed to be directly in front of the needle hole 55.

Figure 12:
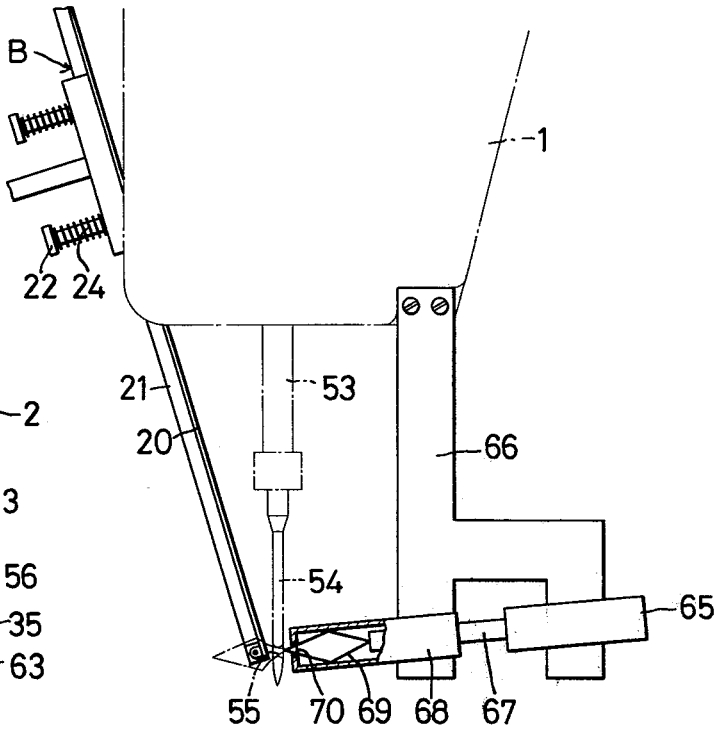
FIG. 12 is a partially cutaway enlarged side view of a portion of the device shown in FIG. 11.
Figure 13:
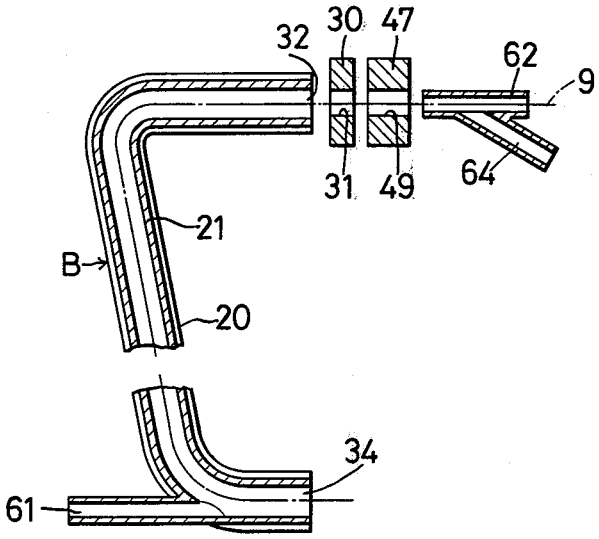
FIG. 13 is an enlarged cross-sectional view of a portion thereof including the thread guide pipe.

In operation of the fourth embodiment, with the thread holes 49 and 31, the inlet 32 and the outlet pipe 62 aligned with one another and the threading tool 69 open beyond the needle hole 55 and directly in front of the thread outlet 34 as shown in FIG. 12 by an alternate long and short dash line, the rollers 16 and 18 feed the thread down the guide tube 14.

Because the blast pipe 64 has already started injection of air toward the lever 47 so that the inside of the tapered portion 36 is set under negative pressure, the thread from the guide tube 14 is sucked thereinto. It passes through the suction pipe 35, the outlet pipe 62 and the thread holes 49 and 31 with air stream. Also, the air blast from the blast pipe 61 at the bottom of the guide pipe B produces a downward air stream therethrough, which sucks the thread 9 from the thread hole 31 into the inlet 32 together with ambient air and drifts it down the pipe B until it gets in the threading tool 69 standing by outside the outlet 34.

At that time, the air cylinder 65 operates to retract the rod 67 so that the threading tool 69 moves back through the needle hole 55 and the opening 70, carrying the thread. When forced through the opening 70, the threading tool 69 is folded, thereby holding the thread securely.

After threading, the driving roller 18, the cover member 21 and the lever 47 move into their inoperative position as in the first embodiment and the turnable member 63 turns to put the outlet pipe 62 to its turned-down position. Then the sewing machine will be put into operation.

In the fourth embodiment, only two blast pipes 61 and 64 are provided. This greatly simplifies piping for compressed air. Also, since after threading the outlet pipe 62 is turned down and the thread guide pipe B is split to release the thread, it runs smoothly without undue bends even with the lever 47 in its lower position.

While the invention has been particularly shown and described with reference to preferred embodiments, it will be understood by those skilled in the art that other changes can be made therein without departing from the spirit and scope of the invention.

What is claimed is:

1. A threading device for a sewing machine to selectively feed a thread from one of several bobbins through the eye (55) of a sewing needle (54) in a needle holder (53) at the working end of an arm (1) comprising in combination:

a. a moveable table (2) disposed above said arm (1) having a plurality of bobbin holders (5) for supporting bobbins with thread (9) thereon for selectively moving said bobbins to a feeding station;

b. guide means (14, 16) below each bobbin to guide and feed thread from the bobbin downwards;

c. a suction pipe (35) at said feeding station with an aperture disposed under said guide means (14), an elongated guide pipe fed by said suction pipe (35) and blast and suction means coupled to said guide pipe to propel a thread therethrough, said guide pipe having an outlet (34) disposed in the adjacent said eye (55);

d. a slidable rod (50) juxtoposed opposite said eye (35) having wire means and grasp means at the outer end thereof so adapted and disposed that said grasp means can penetrate said eye, grasp said thread and pull it through the needle eye; and, e. means for actuating said slidable rod.

2. A threading device as claimed in claim 1 wherein said suction pipe (35) has a portion (36) which is upwardly flanged and downwardly tapered, said suction pipe (35) further having a lower outlet port, a first blast pipe (60) offset to be out of the way of the thread in said portion (36), a curved section and an upper aperture in said guide pipe near said outlet port, a second blast pipe (59) in the vicinity of said outlet port and said guide pipe upper aperture disposed to pneumatically propel a thread from said outlet port into said aperture, and, a third blast pipe (57) at said curved section to drive the thread (9) by air stream toward said outlet (34).

3. A threading device as claimed in claim 1 wherein said guide pipe is formed as a base plate (20) with a removeable cover (21) of U-shape section, guide means and urging means to urge the cover (21) over the base plate (20) to form the guide pipe, and, cover retract means (26, 27, 28, 29) with drive means (25) to remove the cover (21) from the base plate to produce a gap between the base plate (20) and the cover (21).

4. A threading device as claimed in claim 1, said wire and grasp means comprising a wire with a hook at the outer end disposed to penetrate the needle eye and hook onto a thread.

5. A threading device as claimed in claim 1, said wire and grasp means consisting of a threading tool (69) made of a wire in lozenge shape, said rod (67) being slidably fitted into a tube (68), said threading tool (69) being attached to said rod (67), said tube (68) having an opening (70) through which the threading tool is forced in and out, said lozenge shaped wire extending through the needle eye, catching the thread in the lozenge and pulling it through the needle eye as the rod retracts, the folding of the lozenge as it passes through the eye securely holding the thread.

* * * * *